US006565949B1

(12) United States Patent
Wang et al.

(10) Patent No.: US 6,565,949 B1
(45) Date of Patent: May 20, 2003

(54) INK JET RECORDING MEDIA HAVING A COATING COMPRISING ALUMINA PARTICULATE

(75) Inventors: Yongzhong Wang, West Warwick, RI (US); Caridad H. Rahim, Rochester, NY (US)

(73) Assignee: Arkwright Incorporated, Fiskeville, RI (US)

( * ) Notice: Subject to any disclaimer, the term of this patent is extended or adjusted under 35 U.S.C. 154(b) by 0 days.

(21) Appl. No.: 09/330,193

(22) Filed: Jun. 11, 1999

(51) Int. Cl.[7] ..... B41M 5/00
(52) U.S. Cl. ..... 428/195
(58) Field of Search ..... 428/195, 328, 428/329

(56) References Cited

U.S. PATENT DOCUMENTS

| | | | | |
|---|---|---|---|---|
| 4,148,639 | A | | 4/1979 | Sinkovitz et al. |
| 4,316,943 | A | | 2/1982 | Sinkovitz et al. |
| 4,554,181 | A | * | 11/1985 | Cousin et al. |
| 4,910,084 | A | | 3/1990 | Yamasaki et al. |
| 5,104,730 | A | | 4/1992 | Misuda et al. |
| 5,264,275 | A | | 11/1993 | Misuda et al. |
| 5,354,634 | A | | 10/1994 | Misuda et al. |
| 5,439,739 | A | | 8/1995 | Furukawa et al. |
| 5,472,773 | A | | 12/1995 | Misuda et al. |
| 5,494,759 | A | | 2/1996 | Williams et al. |
| 5,523,149 | A | | 6/1996 | Kijimuta et al. |
| 5,605,750 | A | | 2/1997 | Romano et al. |
| 5,624,482 | A | | 4/1997 | Kijimuta et al. |
| 5,635,291 | A | | 6/1997 | Yoshino et al. |
| 5,846,647 | A | | 12/1998 | Yoshino et al. |
| 5,888,635 | A | | 3/1999 | Yang et al. |
| RE36,303 | E | * | 9/1999 | Ogawa et al. |
| 6,114,020 | A | * | 9/2000 | Misuda et al. |

FOREIGN PATENT DOCUMENTS

| | | |
|---|---|---|
| EP | A1 0627324 | 7/1994 |
| EP | A1 0705710 | 10/1996 |
| EP | A2 0881092 | 2/1998 |
| EP | A2 0900667 | 10/1999 |

OTHER PUBLICATIONS

Abstract of Japanese Patent Kokai 252,780/88 (Oct. 19, 1988).
Abstract of Japanese Patent Kokai 160,269/87 (Jul. 16, 1987).
Abstract of Japanese Patent Kokai 91,981/92 (Mar. 25, 1992).
Abstract of Japanese Patent Kokai 259,882/87 (Nov. 12, 1987).

* cited by examiner

*Primary Examiner*—Pamela R. Schwartz
(74) *Attorney, Agent, or Firm*—Birch, Stewart, Kolasch & Birch, LLP

(57) ABSTRACT

The present invention provides ink jet recording media suitable for use in making polymeric film laminates, and film laminates thereof. The recording medium comprises a substrate and two ink-receptive coating layers. The first ink-receptive layer comprises a water-soluble polymer and alumina hydrate particulate, and the second ink-receptive layer comprises a water-soluble quaternary amine-containing polymer. The ink jet recording media are capable of providing recorded images having good image quality waterfastness, and lightfastness.

12 Claims, No Drawings

INK JET RECORDING MEDIA HAVING A COATING COMPRISING ALUMINA PARTICULATE

BACKGROUND OF THE INVENTION

1. Field of the Invention

This invention relates to coated ink jet recording media suitable for use in making film laminates and film laminates thereof. The ink jet recording media are coated with compositions comprising alumina hydrate particulate and are capable of providing recorded images having good image quality, waterfastness, and lightfastness.

2. Brief Description of the Related Art

In recent years, large format ink jet printers have been used to manufacture large color-printed media, such as graphic art indoor and outdoor advertising displays. The large format ink jet printers impart high loadings of ink onto an ink jet recording medium having an ink-receptive coating on its surface.

Since large-format printed media are often displayed indoors or outdoors, the printed medium should possess good water-resistance, smear-resistance and image quality. Most ink jet recording media are coated papers or coated polymeric films, and the ink-receptive coatings thereon usually contain water-soluble or water-swellable polymers. Thus, recorded images on these ink-jet recording media usually have poor water-resistance and smear-resistance. Previous attempts have been made at developing ink jet media to provide recorded images with good image quality, waterfastness, and lightfastness.

For example, Cousin et al., U.S. Pat. 4,554,181 describes coating an ink jet recording sheet with a coating comprising a cationic polymer and a water-soluble polyvalent metal salt to improve image quality, waterfastness, and feathering. Representative cationic polymers are described as homopolymers or copolymers of cationic monomers such as quaternary diallyldialkylammonium chlorides. The coating composition may also comprise a water-swellable polymer binder such as polyvinyl alcohol, polyacrylates, polymethacrylates, or poly(vinyl pyrrolidone).

Furukawa et al., U.S. Pat. No. 5,439,739 describes an ink jet recording medium capable of providing recording images having excellent water-resistance, which is obtained by coating a support with a coating containing a water-soluble polymer and a cross-linking agent. The water-soluble polymer is made by copolymerizing a quaternary salt monomer, an amino group-containing monomer or a carboxyl group-containing monomer, and a monomer selected from acrylarmine, 2-hydroxyethyl (meth)acrylate, and N-vinylpyrrolidone. The coating composition may also contain water-soluble polymers such as polyvinyl alcohol, starch, carboxymethyl cellulose, and cationized gelatin. Inorganic pigments such as alumina sol and cationic colloidal silica and polymer particles such as micron-size polystyrene fine particles can be added to the ink-receiving layer.

Williams et al., U.S. Pat. No. 5,494,759 discloses ink jet printing materials comprising a support and an ink receiving layer containing a pigment, a hydrophilic binder comprising a mixture of polyvinylalcohol, polyvinylpyrrolidone, and a vinyl acetate homopolymer and/or vinyl acetate alkyl acrylate copolymer, and a quaternary ammonium compound.

Published Japanese Pat. Kokai 91,981/92 (Mitsubishi Paper Mills, Ltd.) describes a paper cast-coated with a dispersed mixture of silica, a cationic resin, (polydiallyldimethylammonium)chloride, and a binder resin, (polyvinyl alcohol).

Ink jet recording media that have been color-imaged can be used to make film laminates by laminating a layer of transparent polymeric film over the printed image. The polymeric film protects the printed image and gives the image a glossy appearance. Basically, there are two different types of laminate films that can be applied to color-imaged media. One type of laminate film is a pressure-sensitive, adhesive-coated polymeric film. This laminate film can be laminated onto a color-imaged medium at room temperature and is commonly referred to as a "cold laminate film". Another type of laminate film is a hot-melt, adhesive-coated polymeric film. This type of laminate film must be laminated onto a color-imaged medium at a temperature of 180° F. to 270° F. and is commonly referred to as a "hot laminate film". Usually, cold laminate films can be laminated onto any color-imaged medium, because the soft and tacky pressure-sensitive adhesive-coating on the laminate film sticks to any imaged surface. However, hot laminate films often do not stick well to color-imaged surfaces, because the absorbed dyes in the ink-receptive coating reduce the adhesion of the hot laminate film to the imaged surface. In such instances, the hot laminate film can delaminate from the imaged medium during subsequent handling.

In view of the foregoing problems with many ink jet recording media, it would be desirable to have a medium capable of providing images having good image quality, waterfastness, smear-resistance, and lightfastness. The medium should also be capable of being laminated with films, particularly hot laminate films, after the medium has been color-imaged. The present invention provides such ink jet recording media.

SUMMARY OF THE INVENTION

The present invention provides an ink jet recording medium comprising a substrate and two ink-receptive coating layers. The first ink-receptive layer comprises a water-soluble polymer and alumina hydrate particulate, and the second ink-receptive layer comprises a blend of water-soluble polymers, wherein at least one of the blended polymers is a quaternary amine-containing polymer. The second ink-receptive coating is coated on the first ink-receptive coating.

The substrate is a paper or polymeric film. Suitable polymeric film substrates include, for example, vinyl, polyethylene, polypropylene, polycarbonate, polyimide, polyester, and fluoroplastic films. The polymeric film may be opaque. Suitable paper substrates include, for example, plain paper, clay-coated paper, resin-coated paper, latex-saturated paper, and polyethylene-coated paper. Preferably, polyethylene-coated paper is used.

The first ink-receptive coating layer contains a water-soluble polymer such as, for example, gelatin, polyvinyl alcohol, polyvinyl pyrrolidone, poly(2-ethyl-2-oxazoline), or mixtures thereof Typically, the alumina hydrate particles have a surface area of about 100 to about 200 $m^2/g$ and an average dispersed particle size of about 40 to about 200 nm. Preferably, the first ink-receptive coating layer comprises about 10 to about 60 dry wt. % of alumina hydrate particles and about 40 to about 90 dry wt. % of poly(2-ethyl-2-oxazoline) and has a thickness of about 5 to about 50 $\mu$m.

The second ink-receptive coating layer contains a water-soluble polymer such as, for example, polyvinyl alcohol, polyvinyl pyrrolidone, or poly(2-ethyl-2-oxazoline) blended with a quaternary amine-containing polymer. Preferably, the quaternary amine-containing polymer is a quaternized vinyl pyrrolidone/dimethylaminoethylmethacrylate copolymer. The second ink-receptive coating may also contain a transitional metal salt such as, for example, a water-soluble copper (II) or cobalt (III) salt, particularly copper (II) sulfate, copper (III) acetate, or cobalt (III) acetate and additives such as optical brighteners and pigments. Preferably, the second ink-receptive coating layer has a thickness of about 0.1 to about 10 $\mu$m.

In a preferred ink jet recording medium of this invention, the bottom layer comprises poly(2-ethyl-2-oxazoline) and alumina hydrate particulate, while the top layer comprises a copolymer of vinyl pyrrolidone and quaternized dimethylaminoethylacrylate, stilbene-based optical brightener, and poly(methyl methacrylate) pigment.

This invention also encompasses film laminates comprising transparent polymeric films and the above-described ink jet recording media. The transparent films are laminated to the second ink-receptive coating layers of the media after the media have been imaged. Suitable transparent polymeric films for laminating onto the imaged media include vinyl, polyethylene, polypropylene, polycarbonate, polyimide, polyester, and fluoroplastic films.

DETAILED DESCRIPTION OF THE INVENTION

The present invention relates to an ink jet recording medium comprising a substrate and two ink-receptive coating layers. By the term "substrate", it is meant any suitable paper or polymeric film that can be treated with the coating layers. For example, papers can be chosen from plain papers, clay-coated papers, resin-coated papers (e.g., polyethylene-coated paper) or latex-saturated papers. In the present invention, a polyethylene-coated paper is preferably selected as the substrate, based on its good handling and coating characteristics. Polymeric films can be chosen from vinyl, polyethylene, polypropylene, polycarbonate, polyimide, polyester, polyethylene terephthalate or fluoroplastic films. The thickness of the substrate is not limited and may be selected according to the particular applications of the medium.

The above substrates have two surfaces. The first surface, which is coated with an ink-receptive coating, is called the "front surface", and the opposite surface is called the "back surface" or underside. The chosen substrate may be pretreated, if so desired, by conventional techniques. For example, when the chosen substrate is a polymeric film substrate, a surface treatment, such as corona discharge or a primer coating, may be applied to one surface or both surfaces thereof. For a resin-coated paper substrate, the front and back surfaces may be treated by corona discharge. If a primer coating is used, the coating typically comprises a polymeric resin such as polyester, acrylic, epoxy, polyurethane, or the like, with polyurethane being preferred.

The front surface of the substrate, i.e., imaging surface, is pretreated so that it will adhere better to the ink receiving coating. The back surface, i.e., non-imaging surface, is pretreated in order to provide an adhesion promoting layer for a backing material. A backing material such as a polymeric resin, polymeric film, or paper may then be placed on the back surface in order to reduce electrostatic charge, sheet-to-sheet friction and, and curl of the substrate.

In the present invention, the front surface of the chosen substrate is coated with a two-layer ink-receptive coating. The first (i.e., bottom) ink-receptive layer is designed to absorb ink solvents and the second (i.e., top) ink-receptive layer is designed to absorb dyes found in the ink. The bottom layer is also designed to provide good adhesion to the front surface of the substrate, while the top layer is also designed to provide good adhesion to a laminate film after the top layer has been imaged.

The bottom ink-receptive coating layer comprises a water-soluble polymer resin and alumina hydrate particles. The water-soluble polymer resin in the bottom layer may be chosen from any suitable water-soluble polymer resin such as gelatin, polyvinyl alcohol (PVOH), polyvinyl pyrrolidone (PVP), polyvinyl acetate (PVA), polyethylene oxide (PEO), poly(2-ethyl-2-oxazoline) (PEOX), and mixtures thereof. In the present invention, PEOX and blends containing PEOX are preferred when the substrate is a polyethylene-coated paper, because PEOX adheres well to the paper, even when the front surface of the paper does not have a primer coating.

It is important that alumina hydrate particles be used in the bottom ink-receptive layer in order to obtain good adhesion between the various components in a laminate film product, particularly between the imaged ink-receptive layers and paper substrate. If silica, calcium carbonate, titanium dioxide, or clay particles are used in the bottom layer, then the imaged layers may poorly adhere to the paper substrate resulting in delamination problems. Further, the alumina hydrate particles must be blended thoroughly with the water-soluble polymer to achieve a uniform coating. Preferably, the alumina hydrate particles are incorporated into the coating layer by adding an alumina sol to the water-soluble polymer. If the mixture containing the alumina hydrate particles and water-soluble polymer is not vigorously stirred so that the particles and polymer are thoroughly blended together, the mixture tends to form a gel. Since it is difficult to uniformly coat the gel onto the paper substrate, the bottom ink-receptive layer in such media products is usually discontinuous and non-uniform. When media products having such non-uniform coatings are color-imaged, the color density and quality tends to be poor.

Preferably, the alumina hydrate particles have a surface area of 100 to 200 $m^2/g$ and an average dispersed particle size of 40 to 200 nm. The content of the alumina hydrate particles in the bottom ink-receptive layer is preferably from 10 to 150% by dry weight based on the weight of the water-soluble polymeric resin in the bottom layer. If the content of the particulate exceeds 150% by dry weight of the polymeric resin, the bottom layer tends not to effectively adhere to the paper substrate.

In the present invention, the top ink-receptive coating layer comprises a blend of water-soluble polymers. At least one of the water-soluble polymers in the blend is a quaternary amine-containing polymer. It is important that the quaternary amine-containing polymer be water-soluble to allow more dye molecules to interact with the quaternary amine-containing polymer. Although the quaternary amine-containing polymer is water-soluble, the cationic groups in the polymer are still capable of reacting with and stabilizing the anionic dyes contained in the ink. If a non-water soluble quaternary amine-containing polymer is used, more dye molecules tend to remain on the surface of the coating layer and these molecules do not interact with the quaternary amine-containing polymer. In preparing the blend of water-soluble polymers for use as the top coating layer, the water-soluble quaternary amine-containing polymer can be blended with the same water-soluble polymer resin used for the first ink-receptive (bottom) layer, or it can be blended with a different water-soluble polymer resin. It is preferred that the water-soluble quaternary amine-containing polymer be blended with a water-soluble polymer selected from the group consisting of PVOH, PVP, and PEOX. It is further preferred that the water-soluble quaternary amine-containing polymer be a copolymer of vinyl pyrrolidone and quaternized dimethylaminoethylacrylate (such as commercially available Gafquat®, from ISP Technologies, Inc.). In this respect, a copolymer of vinyl pyrrolidone and quaternized dimethylaminoethylacrylate is preferred because it gives a glossy and flexible coating which can also fix dyes in the top ink-receptive layer.

The top ink-receptive coating layer may also contain a transitional metal salt. If a transitional metal salt(s) is used in the top layer, it is water-soluble and preferably chosen from the group consisting of copper sulfate, copper acetate, and cobalt acetate. Copper sulfate is especially preferred because it is inexpensive and widely available. The transitional metal ions in the top layer help to stabilize dyes and greatly increase the light-fastness of the ink receiving coating. The content of the transitional metal salt (e.g., copper sulfate) is preferably from about 0.1% to about 20% by dry weight of the water-soluble polymeric resin(s) in the top layer.

Pigments, and optical brighteners, and other conventional additives such as UV blockers/stabilizers, and surface active agents can also be used in the top ink-receptive coating layer, depending on the intended application of the ink jet recording medium. Examples of suitable pigments include polyolefins, polystyrene, starch, polyurethane, poly(methyl methacrylate) (such as Soken® MR10G, available from Espirit Chemical Company), polytetrafluoroethylene (such as Shamrock SST2SP5, available from Shamrock Chemical Company), and the like. Examples of suitable optical brighteners include stilbene-based and distyryl biphenyl-based optical brighteners such as those available in the Tinopal® series from Ciba-Geigy.

In a preferred ink jet recording medium of this invention, the bottom ink-receptive layer comprises poly(2-ethyl-2-oxazoline) and alumina hydrate particulate, while the top ink-receptive layer comprises a copolymer of vinyl pyrrolidone and quaternized dimethylaminoethylacrylate, poly (vinyl alcohol), stilbene-based optical brightener, and poly (methyl methacrylate) pigment.

The ink jet recording media of this invention are particularly useful for making laminate films, where a transparent polymeric film is laminated onto the top ink-receptive layer and underside of the substrate after the medium has been imaged, i.e., printed. Conventional techniques can be used to make the laminate films. Preferably, the film is laminated onto the imaged medium by a pressure-sensitive or hot-melt adhesive. Suitable transparent polymeric films that can be laminated onto the imaged medium include vinyl, polyethylene, polypropylene, polycarbonate, polyimide, polyester, and fluoroplastic films.

The invention is further illustrated by the following examples using the below test methods, but these examples should not be construed as limiting the scope of the invention.

Test Methods

Adhesion of Imaged Coating to Laminate Film

In some of the following examples, the adhesion of the imaged coating (i.e., the ink-receptive coating containing an image) to a laminate film was measured by a peel strength tester used in the pressure-sensitive adhesive industry. A substrate coated with the ink-receptive layers of the present invention was imaged on a particular printer with a particular ink set and printed with a test pattern comprising (⅞ inch wide, about 10 inch long) color stripes (yellow, cyan, magenta, blue, green, red and black) described in further detail in the following examples.

After the printed color stripes were dried, a plain paper stripe one inch wide was placed perpendicularly on top of the color stripes, and then the printed substrate was laminated between two layers of hot laminate film on a laminating machine at a temperature ranging from 180° F. to 270° F. The laminated medium was then cut in the direction of the plain paper strip down the middle of the plain paper stripe, so that the laminate film on the image side could be lifted for testing. The laminate film on each color was cut into a ⅜ inch width stripe (in the middle of the printed stripe area). The laminate film was then peeled off from the imaged area and the peel strength was measured with a 3M 90 Slip/Peel Tester (Instrumentors, Inc.).

Lightfastness

Ink jet image colors fade under exposure to sunlight. The commonly used coordinate system for color is the CIE-L*a*b* system. In order to quantitatively measure the lightfastness, L*a*b* values are measured before (initial L*a*b* values) and after (final L*a*b* values) the samples are exposed to sunlight. $\Delta E=((L_f^*-L_i^*)^2+(a_f^*-a_i^*)^2+(b_f^*-b_i^*)^2)^{1/2}$. ΔE is a measure of the color difference between the faded and unfaded colors. Samples and colors having poor lightfastness have larger ΔE values. The values of L*a*b* were measured with a X-Rite 918 0/45 Colorimeter (X-Rite, Inc.).

The lightfastness of the laminated, imaged samples was determined by exposing the samples to sunlight over a period of two weeks in the summer. The laminated, imaged samples were exposed to sunlight by taping them to the outside surface of an office window. In some instances, the lightfastness of the samples was determined by manually observing the samples before and after being exposed to sunlight. In other instances, the L*a*b* values of the samples were measured before and after being exposed to sunlight and the ΔE of the samples was calculated as described above.

EXAMPLES

In the following examples, the formulas are based on parts by weight, unless otherwise indicated, and various trade names are used to denote certain ingredients including the following:

- 30% Ammonium hydroxide: available from VMR Scientific, Inc., and manufactured by J.T. Baker, Inc.
- Micral 1440: alumina trihydrate powder, manufactured by J.M. Huber Corp.
- Lumiten I-RA: sodium sulfoalkyl sulfoxylate, manufactured by BASF Corp.
- Sancure 1301: Aliphatic waterborn urethane polymer, manufactured by BF Goodrich Co.
- Xama-7: Pentaerythritol-tris-(B-(N-Aziridinyl) propionate, available from BF Goodrich Co.
- Aquazol AI: Poly(2-ethyl-2-oxazoline), manufactured by Polymer Chemistry Innovations Inc.
- Aquazol 500: Poly(2-ethyl-2-oxazoline), manufactured by Polymer Chemistry Innovations Inc.
- Dispal 23N4-20: alumina sol, manufactured by Vista Chemical Co.
- Dispal 14N4-25: alumina sol, manufactured by Vista Chemical Co.
- Airvol 823: polyvinyl alcohol, available from Air Products. Inc.
- Intracid Violet: blue dye, available from Crompton & Knowles Corp.

Tinopal SFP: optical brightener, manufactured by Ciba Specialty Chemicals Corp.

Gafquat 755N: quaternarized vinyl pyrrolidone/dimethylaminoethylmeth-acrylate copolymers. manufactured by ISP Technologies, Inc.

Gafquat HS-100: Vinyl pyrrolidone/methyacryaminopropyl trimethyl-ammonium chloride copolymer, manufactured by ISP Technologies, Inc.

Tinuvin 213: UV absorber, manufactured by Ciba Specialty Chemicals Corp.

Polymer ACP-1005: Vinyl pyrrolidone/acrylic acid copolymer, manufactured by ISP Technologies, Inc.

Snowtex-O: colloidal silica, manufactured by Nissan Chemical Industries, Ltd.

PVP K90: Polyvinyl pyrrolidone, manufactured by ISP Technologies, Inc.

Example 1

A polyethylene-coated paper (available from Jencoat Paper, Inc.) was coated with an inter-coating (Formula IC-1) using a #56 metering rod. The inter-coating was applied to the glossy side of the paper and dried in an oven at 250° F. for about 1.5 minutes.

| Inter-Coating Formula: IC-1 | |
|---|---|
| Tinuvin 213 | 0.2 parts |
| Water | 32.82 parts |
| Aquazol Al | 7.48 parts |
| Methanol | 21.2 parts |
| Isopropyl alcohol | 15.3 parts |
| Dispal 14N4-25 | 23.0 parts |

A top-coating (Formula TC-1) was then applied to the inter-coating using a #16 metering rod and dried in an oven at 250° F. for about 1 minute.

| Top-Coating Formula: TC-1 | |
|---|---|
| Tinuvin 213 | 0.11 parts |
| Tinopal SFP | 0.25 parts |
| Water | 27.5 parts |
| Methanol | 11.1 parts |
| Isopropyl alcohol | 5.5 parts |
| Gafquat HS100 | 5.6 parts |

Example 2

A polyethylene-coated paper (available from Jencoat Paper, Inc.) was coated with an inter-coating (Formula IC-2) using a #56 metering rod. The inter-coating was applied to the glossy side of the paper and dried in an oven at 250° F. for about 1.5 minutes.

| Inter-Coating Formula: IC-2 | |
|---|---|
| Tinuvin 213 | 0.15 parts |
| Water | 32.82 parts |
| Aquazol Al | 7.48 parts |
| Methanol | 21.2 parts |
| Isopropyl alcohol | 15.3 parts |
| Dispal 14N4-25 | 23.0 parts |

A top-coating (Formula TC-2) was then applied to the inter-coating using a #16 metering rod and dried at 250° F. for about 1 minute.

| Top-Coating Formula: TC-2 | |
|---|---|
| Tinuvin 213 | 0.06 parts |
| Tinopal SFP | 0.25 parts |
| Water | 27.5 parts |
| Methanol | 11.1 parts |
| Isopropyl alcohol | 5.5 parts |
| Gafquat HS100 | 5.6 parts |

Example 3

A polyethylene-coated paper (available from Jencoat Paper, Inc.) was coated with an inter-coating (Formula IC-3) using a #56 metering rod. The inter-coating was applied to the glossy side of the paper, and the inter-coated paper was dried in an oven at 250° F. for about 1.5 minutes.

| Inter-Coating Formula: IC-3 | |
|---|---|
| Tinuvin 213 | 0.10 parts |
| Water | 32.82 parts |
| Aquazol AI | 7.48 parts |
| Methanol | 21.2 parts |
| Isopropyl alcohol | 15.3 parts |
| Dispal 14N4-25 | 23.0 parts |

A top-coating (Formula TC-2) was then applied to the inter-coating using a #16 metering rod and dried at 250° F. for about 1 minute.

Example 4

A polyethylene-coated paper (available from Jencoat Paper, Inc.) was coated with an inter-coating (Formula IC-4) using a #56 metering rod. The inter-coating was applied to the glossy side of the paper and dried in an oven at 250° F. for about 1.5 minutes.

| Inter-Coating Formula: IC-4 | |
|---|---|
| Tinuvin 213 | 0.05 parts |
| Water | 32.82 parts |
| Aquazol AI | 7.48 parts |
| Methanol | 21.2 parts |
| Isopropyl alcohol | 15.3 parts |
| Dispal 14N4-25 | 23.0 parts |

A top-coating (Formula TC-2) was then applied to the inter-coating using a #16 metering rod and dried at 250° F. for about 1 minute.

Example 5

A polyethylene-coated paper (available from Jencoat Paper, Inc.) was coated with an inter-coating (Formula IC-4) using a #56 metering rod. The inter-coating was applied to the glossy side of the paper and dried in an oven at 250° F. for about 1.5 minutes. A top-coating (Formula TC-1) was then applied to the inter-coating using a #16 metering rod and dried in an oven at 250° F. for about 1 minute.

Lightfastness Test Results for Examples 1–5

The coated ink jet papers in Examples 1–5 were imaged on an Encad Croma 24 ink jet printer with GA ink. The images were allowed to dry in an ambient environment (67° F. and 68 RH (relative humidity)). The imaged papers were then laminated with a 1.7 mil Digiseal laminate film (USI, Inc.) on an USI roll laminator (USI Corporate) at 220° F. and speed setting 1. The lightfastness of the laminated samples in Examples 1–5 was determined by manually observing the samples before and after they were exposed to sunlight as described above under Test Methods. It was found that all of the samples demonstrated good lightfastness.

Adhesion Test Results for Examples 1–5

The coated ink jet papers were imaged on an Encad Croma 24 ink jet printer, as described above, and a laminate film was applied to the colored imaged area via a USI roll laminator. The laminate film was then peeled off from the colored imaged area by hand. The adhesion between the laminate film and the colored imaged area was observed qualitatively. It was found that the adhesion of the laminate film to the colored imaged area was rather strong. The laminate film did not de-laminate from the colored imaged area even when the laminated samples were folded back and forth several times.

Example 6

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter ($g/m^2$).

| Primer Coating Formula: PC-1 | |
|---|---|
| Water | 40.6 parts |
| Micral 1440 | 0.2 parts |
| Lumiten I-RA | 0.3 parts |
| Sancure 1301 | 23.0 parts |
| Methanol | 33.4 parts |
| 50% Ammonia hydroxide | 0.5 parts |
| Xama-7 | 2.0 parts |

The front surface (glossy side) of the paper was coated with an inter-coating (Formula IC-6) using a #60 metering rod and dried in an oven at 250° F. for about 1.5 minutes.

| Inter-Coating Formula: IC-6 | |
|---|---|
| Water | 29.92 parts |
| Aquazol AI | 7.48 parts |
| Dispal 14N4-25 | 23.0 parts |
| Methanol | 21.2 parts |
| Isopropyl alcohol | 18.4 parts |

A top-coating (Formula TC-4) was then applied to the inter-coating using a #26 metering rod and dried in an oven at 250° F. for about 1 minute.

| Top-Coating Formula: TC-4 | |
|---|---|
| Copper Sulfate[1] | 0.1 parts |
| Tinopal SFP | 0.5 parts |

-continued

| Top-Coating Formula: TC-4 | |
|---|---|
| Water | 50.4 parts |
| Gafquat 755N | 11.0 parts |
| Methanol | 22.0 parts |
| Isopropyl alcohol | 16.0 parts |

Copper (II) sulfate pentahydrate, purchased from Fisher Scientific, Inc. (manufactured by Acros Organics)

The weights of the inter-coating and top-coating were about 15 $g/m^2$ and 2 $g/m^2$, respectively.

Example 7

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes.

The front surface (glossy side) of the paper was coated with an inter-coating (Formula IC-7) using a #60 metering rod and dried in an oven at 250° F. for about 1.5 minutes.

| Inter-Coating Formula: IC-7 | |
|---|---|
| Water | 34.88 parts |
| Aquazol AI | 8.22 parts |
| Dispal 14N4-25 | 19.3 parts |
| Methanol | 21.2 parts |
| Isopropyl alcohol | 16.4 parts |

A top-coating (Formula TC-5) was then applied to the inter-coating using a #26 metering rod and dried in an oven at 250° F. for about 1 minute.

| Top-Coating Formula: TC-5 | |
|---|---|
| Copper Sulfate[1] | 0.15 parts |
| Tinopal SFP | 0.5 parts |
| Water | 50.35 parts |
| Gafquat 755N | 11.0 parts |
| Methanol | 22.0 parts |
| Isopropyl alcohol | 16.0 parts |

Copper (II) sulfate pentahydrate, purchased from Fisher Scientific, Inc. (manufactured by Arcos Organics)

The weights of the inter-coating and top-coating were about 15 $g/m^2$ and 2 $g/m^2$, respectively.

Example 8

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter ($g/m^2$).

The front surface (glossy side) of the paper was coated with an inter-coating (Formula IC-8) using a #60 metering rod and dried in an oven at 250° F. for about 1.5 minutes.

| Inter-Coating Formula: IC-8 | |
|---|---|
| Water | 28.08 parts |
| Aquazol AI | 7.02 parts |
| Dispal 14N4-25 | 25.3 parts |
| Methanol | 21.2 parts |
| Isopropyl alcohol | 18.4 parts |

A top-coating (Formula TC-5) was then applied to the inter-coating using a #26 metering rod and dried in an oven at 250° F. for about 1 minute.

| Top-Coating Formula: TC-6 | |
|---|---|
| Copper Sulfate[1] | 0.2 parts |
| Tinopal SFP | 0.5 parts |
| Water | 50.3 parts |
| Gafquat 755N | 11.0 parts |
| Methanol | 22.0 parts |
| Isopropyl alcohol | 16.0 parts |

Copper (II) sulfate pentahydrate, purchased from Fisher Scientific, Inc. (manufactured by Arcos Organics)

The weights of the inter-coating and top-coating were about 15 g/m$^2$ and 2 g/m$^2$, respectively.

Example 9

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter (g/m$^2$).

The front surface (glossy side) of the paper was coated with an inter-coating (Formula IC-6) using a #60 metering rod and dried in an oven at 250° F. for about 1.5 minutes. A top-coating (Formula TC-5) was then applied to the inter-coating using a #26 metering rod and dried in an oven at 250° F. for about 1 minute. The weights of the inter-coating and top-coating were about 15 g/m$^2$ and 2 g/m$^2$, respectively.

Example 10

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter (g/m$^2$).

The front surface (glossy side) of the paper was coated with an inter-coating (Formula IC-6) using a #60 metering rod and dried in an oven at 250° F. for about 1.5 minutes. A top-coating (Formula TC-6) was then applied to the inter-coating using a #26 metering rod and dried in an oven at 250° F. for about 1 minute. The weights of the inter-coating and top-coating were about 15 g/m$^2$ and 2 g/m$^2$, respectively.

Example 11

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter (g/m$^2$).

The front surface (glossy side) of the paper was coated with an inter-coating (Formula IC-6) using a #60 metering rod and dried in an oven at 250° F. for about 1.5 minutes. A top-coating (Formula TC-4) was then applied to the inter-coating using a #26 metering rod and dried in an oven at 250° F. for about 1 minute. The weights of the inter-coating and top-coating were about 15 g/m$^2$ and 2 g/m$^2$, respectively.

Example 12

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter (g/m$^2$).

The front surface (glossy side) of the paper was coated with an inter-coating (Formula IC-7) using a #60 metering rod and dried in an oven at 250° F. for about 1.5 minutes. A top-coating (Formula TC-6) was then applied to the inter-coating using a #26 metering rod and dried in an oven at 250° F. for about 1 minute. The weights of the inter-coating and top-coating were about 15 g/m$^2$ and 2 g/m$^2$, respectively.

Example 13

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter (g/m$^2$).

The front surface (polyethylene-coated glossy side) of the paper was coated with an inter-coating (Formula IC-8) using a #60 metering rod and dried in an oven at 250° F. for about 1.5 minutes. A top-coating (Formula TC-4) was then applied to the inter-coating using a #26 metering rod and dried in an oven at 250° F. for about 1 minute. The weights of the inter-coating and top-coating were about 15 g/m$^2$ and 2 g/m$^2$, respectively.

Example 14

A polyethylene-coated paper (available from Jencoat Paper, Inc.) was coated with a primer coating (Formula PC-1). The primer coating was applied to the back surface (rough side) of the paper using a #6 metering rod and dried in an oven at 250° F. for about 0.5 minutes. The weight of the primer coating was about 2 grams per square meter (g/m$^2$).

The front surface (glossy side) of the paper was coated with an inter-coating (Formula IC-8) using a #60 metering rod and dried in an oven at 250° F. for about 1.5 minutes. A top-coating (Formula TC-4) was then applied to the inter-coating using a #26 metering rod and dried in an oven at 250° F. for about 1 minute. The weights of the inter-coating and top-coating were about 15 g/m$^2$ and 2 g/m$^2$, respectively.

Adhesion Test Results for Examples 6–14

The media in Examples 6–14 were imaged on an Encad Croma 24 ink jet printer with GA ink. The samples for the adhesion test were made in the manner described above under Test Methods. The layer of laminate film on the imaged surface was cut into a ⅜ inch width stripe for each color. The laminate film was lifted from the imaged area through the paper spacer. The laminate film was then attached to a peel tester (3M90 Slip/Peel Tester, Instrumentors, Inc.). The peel strength was measured for 25 seconds average at 12 in/min. The peel strength (in grams) of the laminate film to the imaged color stripes was measured and shown in the following Table 1.

TABLE 1

Peel Strength (grams) of Laminate Film to Printed Stripes

| Example No | White | Yellow | Cyan | Magenta | green | blue | red | black |
|---|---|---|---|---|---|---|---|---|
| 6 | 200+ | 74.4 | 200+ | 72.0 | 152.3 | 39.8 | 77.8 | 200+ |
| 7 | 200+ | 56.0 | 77.1 | 110.0 | 200− | 200+ | 183.1 | 200+ |
| 8 | 200+ | 110.3 | 115.6 | 175.3 | 200+ | 156.8 | 128.4 | 200+ |
| 9 | 200+ | 51.4 | 52.5 | 197.1 | 200+ | 200+ | 167.5 | 200+ |
| 10 | 200+ | 100 | 97.0 | 200+ | 200+ | 191.3 | 198.8 | 200+ |
| 11 | 200+ | 119.0 | 109.7 | 199.7 | 181.2 | 89.6 | 97.5 | 200+ |
| 12 | 200+ | 57.8 | 35.5 | 200+ | 171.4 | 128.1 | 157.1 | 200+ |
| 13 | 200+ | 51.5 | 83.5 | 168.4 | 198.3 | 144.6 | 147.3 | 200+ |
| 14 | 200+ | 147.1 | 132.0 | 200+ | 186.6 | 86.4 | 103.9 | 200+ |

Note:
200+ indicate that the peel strength is higher than the machine can measure.

Lightfastness Test Results for Examples 6–14

The media in Examples 6–14 were imaged on an Encad Croma 24 ink jet printer with GA ink. The printed pattern contained several colored stripes (yellow, magenta, cyan, green, blue, red and black). The second colors (green, blue and red) and tertiary color (black) were all made of two or three primary colors (yellow, magenta and cyan). The imaged media were allowed to dry in an ambient environment. The imaged samples were then laminated with a 1.7 mil Digiseal laminate film (USI corp.) on an USI roll laminator at 220° F. at speed setting 1.

The samples in Examples 6–14 were taped onto the outside surface of an office window and exposed to sunlight for two weeks. The values of L*a*b* were measured for each color before and after exposure to the sunlight and ΔE was calculated as described above under Test Methods.

TABLE 3

ΔE Measurement (Window)

| Example No | White | yellow | cyan | Magenta | green | blue | red | black |
|---|---|---|---|---|---|---|---|---|
| 6 | 3.77 | 1.53 | 5.18 | 58.75 | 1.48 | 5.92 | 4.40 | 0.65 |
| 7 | 4.57 | 1.00 | 5.53 | 44.79 | 2.14 | 5.55 | 5.50 | 1.79 |
| 8 | 2.74 | 0.81 | 4.87 | 13.43 | 2.24 | 4.12 | 1.63 | 2.00 |
| 9 | 3.70 | 0.41 | 6.95 | 62.38 | 0.66 | 4.97 | 5.13 | 4.35 |
| 10 | 4.41 | 1.44 | 6.54 | 53.17 | 1.43 | 4.97 | 3.90 | 0.99 |
| 11 | 2.81 | 0.78 | 6.17 | 17.79 | 4.10 | 8.80 | 8.48 | 1.75 |
| 12 | 3.98 | 0.76 | 4.95 | 45.22 | 1.85 | 4.15 | 3.50 | 1.03 |
| 13 | 4.61 | 0.82 | 4.52 | 29.81 | 3.04 | 4.48 | 1.54 | 2.62 |
| 14 | 2.92 | 3.71 | 4.28 | 9.53 | 1.91 | 4.67 | 3.96 | 2.59 |

Example 15

A polyethylene-coated paper (available from Jencoat Paper, Inc.) with matte surfaces was coated with a primer coating (Formula PC-2). The primer coating was applied to the back surface of the paper using a #6 metering rod and dried in an oven at 250° F. for about 0.5 minutes. The weight of the primer coating was about 2 grams per square meter ($g/m^2$).

| Primer Coating Formula: PC-2 | |
|---|---|
| Water | 40.6 parts |
| Micral 1440 | 0.2 parts |
| Lumiten I-RA | 0.3 parts |
| Sancure 1301 | 23.0 parts |
| Methanol | 33.4 parts |
| 30% Ammonia hydroxide | 0.5 parts |
| Xama-7 | 2.0 parts |

The back surface of the paper was coated with an inter-coating (Formula IC-9) using a #60 metering rod and dried in an oven at 250° F. for about 1.5 minutes. The weight of the inter-coating was about 12 grams per square meter ($g/m^2$).

| Inter-Coating Formula: IC-9 | |
|---|---|
| Water | 30.92 parts |
| Aquazol AI | 5.98 parts |
| Dispal 14N4-25 | 18.40 parts |
| Methanol | 23.12 parts |
| Isopropyl alcohol | 21.00 parts |
| 0.1% Intracid Blue water Solution | 0.60 parts |

A top-coating (Formula TC-7) was then applied to the inter-coating using a #16 metering rod and dried in an oven at 250° F. for about 1 minute. The weight of the top-coating were about 3 $g/m^2$.

| Top-Coating Formula: TC-7 | |
|---|---|
| 10% Airvol 823 water solution | 59.90 parts |
| Methanol | 20.45 parts |
| Isopropyl alcohol | 13.22 parts |
| Gafquat 755N | 5.52 parts |
| Soken MR-10G | 0.09 parts |
| Tinopal SFP | 0.82 parts |

Example 16

A white polyester film (available from DuPont) was coated with a primer coating (Formula PC-2). The primer coating was applied to the back surface of the film using a #6 metering rod and dried in an oven at 250° F. for about 0.5 minutes. The weight of the primer coating was about 2 grams per square meter ($g/m^2$).

The back surface of the film was coated with an inter-coating (Formula IC-9) using a #60 metering rod and dried in an oven at 250° F. for about 1.5 minutes. The weight of the inter-coating was about 12 grams per square meter ($g/m^2$).

A top-coating (Formula TC-7) was then applied to the inter-coating using a #16 metering rod and dried in an oven at 250° F. for about 1 minute. The weight of the top-coating were about 3 $g/m^2$.

Example 17

A sample was made in the same manner as the sample in Example 15, except the inter-coating formula had the following composition (Formula IC-10).

| Inter-Coating Formula: IC-10 | |
|---|---|
| Water | 26.31 parts |
| Aquazol AI | 5.98 parts |
| Dispal 23N4-20 | 23.0 parts |
| Methanol | 23.1 parts |
| Isopropyl alcohol | 21.00 parts |
| 0.1% Intracid Blue water Solution | 0.60 parts |

Adhesion Test Results for Examples 15–17

The media in Examples 15–17 were imaged on an Encad Croma 24 ink jet printer with GA ink. The samples for the adhesion test were made in the manner described above under Test Methods. The imaged samples were laminated with a 3.0 mil Digiseal laminate film (USI Corp.) on an USI roll laminator at 220° F. and a speed setting of 1. The layer of laminate film on the imaged surface was cut into a ⅜ inch width stripe for each color. The laminate film was lifted from the imaged area through the paper spacer. The laminate film was then attached to a peel tester (3M90 Slip/Peel Tester. Instrumentors, Inc.). The peel strength was measured for 25 seconds average at 12 in/min. The peel strength (in grams) of the laminate film to the imaged color stripes was measured and shown in the following Table 2.

TABLE 2

Peel Strength (grams) of Laminate Film to Printed Strips

| | White | yel-low | Cyan | magenta | Green | Blue | Red | black |
|---|---|---|---|---|---|---|---|---|
| GS ink | | | | | | | | |
| 15 | 200+ | 127.4 | 170.7 | 172.3 | 67.5 | 95.2 | 97.7 | 15.4 |
| 16 | 200+ | 200+ | 200+ | 200+ | 88.0 | 98.1 | 100.6 | 6.8 |
| 17 | 200+ | 169.3 | 200+ | 179.5 | 105.7 | 93.8 | 111.2 | 14.3 |
| GA ink | | | | | | | | |
| 15 | 200+ | 129.7 | 200+ | 200+ | | 62.3 | 27.7 | 4.6 |
| 16 | 200+ | 148.0 | 200+ | 200+ | 21.6 | 46.8 | 30.7 | 6.7 |
| 17 | 200+ | 95.3 | 200+ | 200+ | 7.9 | 46.8 | 23.0 | 2.8 |

Note:
200+ indicate that the peel strength is higher than the machine can measure.

Example 18

A single matte-surface polyethylene-coated paper (available from Jencoat Paper, Inc.) was coated with a primer coating (Formula PC-2) on the matte surface. The primer coating was applied to the matte surface of the paper using a #6 metering rod and dried in an oven at 250° F. for about 0.5 minutes. The weight of the primer coating was about 2 grams per square meter (g/m$^2$). The glossy surface of the paper was coated with an inter-coating (Formula IC-11) using a #60 metering rod and dried in an oven at 250° F. for about 1.5 minutes.

| Inter-Coating Formula: IC-11 | |
|---|---|
| 20% Aquazol AI water solution | 37.4 parts |
| Dispal 14N4-25 | 23.0 parts |
| Methanol | 21.2 parts |
| Isopropyl alcohol | 18.4 parts |

A top-coating (Formula TC-8) was then applied to the dried inter-coating using a #26 metering rod and dried in an oven at 250° F. for about 1 minute.

| Top-Coating Formula: TC-8 | |
|---|---|
| Water | 50.3 parts |
| Gafquat 755N | 11.0 parts |
| Copper Sulfate | 0.20 parts |
| Methanol | 22.0 parts |
| Isopropyl Alcohol | 16.0 parts |
| Tinopal SFP | 0.5 parts |

Example 19

A single matte-surface polyethylene-coated paper (available from Jencoat Paper, Inc.) was coated with a primer coating (Formula PC-2) on the matte surface. The primer coating was applied to the matte surface of the paper using a #6 metering rod and dried in an oven at 250° F. for about 0.5 minutes. The weight of the primer coating was about 2 grams per square meter (g/m$^2$). The glossy surface of the paper was coated with an inter-coating (Formula IC-11) using a #60 metering rod and dried in an oven at 250° F. for about 1.5 minutes. A top-coating (Formula TC-9) was then applied to the dried inter-coating using a #26 metering rod and dried in an oven at 250° F. for about 1 minute.

| Top-Coating Formula: TC-9 | |
|---|---|
| Soken MR-10G | 0.25 parts |
| Water | 47.45 parts |
| Gafquat 755N | 5.5 parts |
| 15% Airvol 823 water solution | 8.0 parts |
| Copper Sulfate | 0.20 parts |
| Cobalt Acetate | 0.10 parts |
| Methanol | 22.0 parts |
| Isopropyl Alcohol | 16.0 parts |
| Tinopal SFP | 0.5 parts |

Example 20

A single matte-surface polyethylene-coated paper (available from Jencoat Paper, Inc.) was coated with a primer coating (Formula PC-2) on the matte surface. The primer coating was applied to the matte surface of the paper using a #6 metering rod and dried in an oven at 250° F. for about 0.5 minutes. The weight of the primer coating was about 2 grams per square meter (g/m$^2$). The glossy surface of the paper was coated with an inter-coating (Formula IC-11) using a #60 metering rod and dried in an oven at 250° F. for about 1.5 minutes. A top-coating (Formula TC-10) was then applied to the dried inter-coating using a #26 metering rod and dried in an oven at 250° F. for about 1 minute.

| Top-Coating Formula: TC-10 | |
|---|---|
| Soken MR-10G | 0.25 parts |
| Water | 46.35 parts |
| 15% Airvol 823 water solution | 14.6 parts |
| Copper Sulfate | 0.20 parts |
| Cobalt Acetate | 0.10 parts |
| Methanol | 22.0 parts |
| Isopropyl Alcohol | 16.0 parts |
| Tinopal SFP | 0.5 parts |

Example 21

A single matte-surface polyethylene-coated paper (available from Jencoat Paper, Inc.) was coated with a primer coating (Formula PC-2) on the matte surface. The primer coating was applied to the matte surface of the paper using a #6 metering rod and dried in an oven at 250° F. for about 0.5 minutes. The weight of the primer coating was about 2 grams per square meter (g/m$^2$). The glossy surface of the paper was coated with an inter-coating (Formula IC-11) using a #60 metering rod and dried in an oven at 250° F. for about 1.5 minutes. A top-coating (Formula TC-8) was then applied to the dried inter-coating using a #26 metering rod and dried in an oven at 250° F. for about 1 minute.

| Inter-Coating Formula: IC-12 | |
|---|---|
| 20% Aquazol AI water solution | 29.9 parts |
| Dispal 14N4-25 | 18.4 parts |
| Water | 7.0 parts |
| Methanol | 23.7 parts |
| Isopropyl alcohol | 21.0 parts |

Example 22

A sample was made in the same manner as the sample made in Example 21, except that top-coating formula TC-9 was applied to inter-coating formula IC-12 for this sample.

Example 23

A sample was made in the same manner as the sample made in Example 21, except that top-coating formula TC-10 was applied to inter-coating formula IC-12 for this sample.

Adhesion Test Results for Examples 18–23

The media in Examples 18–23 were imaged on an Encad Croma 24 ink jet printer with GA ink. The samples for the adhesion test were made in the manner described above under Test Methods. The imaged samples were laminated with a 1.7 mil Digiseal laminate film (USI Corp.) on an USI roll laminator at 220° F. and a speed setting of 1. The layer of laminate film on the imaged surface was cut into a ⅜ inch width stripe for each color. The laminate film was lifted from the imaged area through the paper spacer. The laminate film was then attached to a peel tester (3M90 Slip/Peel Tester, Instrumentors, Inc.). The peel strength was measured for 25 seconds average at 12 in/min. The peel strength (in grams) of the laminate film to the imaged color stripes was measured and shown in the following Table 3.

TABLE 3

Peel Strength (grams) of 1.7 mil Laminate Film to Printed Strips

| | White | yel-low | cyan | magenta | Green | Blue | Red | black |
|---|---|---|---|---|---|---|---|---|
| GS ink | | | | | | | | |
| 18 | 200+ | 200+ | 200+ | 200+ | 200+ | 200+ | 143.7 | 85.7 |
| 19 | 158.1 | 200+ | 200+ | 200+ | 200+ | 200+ | 72.2 | 38.8 |
| 20 | 200+ | 200+ | 200+ | 200+ | 111.4 | 185.4 | 47.3 | 104.3 |
| 21 | 200+ | 156.2 | 154.7 | 200+ | 110.2 | 131.4 | 145.3 | 141.3 |
| 22 | 200+ | 200+ | 200+ | 200+ | 123.3 | 141.7 | 168.1 | 135.4 |
| 23 | 200+ | 200+ | 200+ | 146.9 | 126.8 | 198.2 | 127.0 | 142.4 |
| GA ink | | | | | | | | |
| 18 | — | — | 200+ | — | 160.4 | 200+ | 200+ | 200+ |
| 19 | — | — | — | — | — | — | — | 200+ |
| 20 | — | — | — | — | 200+ | 200+ | 200+ | 200+ |
| 21 | — | 200+ | 200+ | — | 163.7 | 128.0 | 200+ | 196.8 |
| 22 | — | — | — | — | 200– | 200+ | 200+ | 200+ |
| 23 | — | 200+ | 200+ | — | 187.8 | 193.7 | 200+ | 175.3 |
| HP750 C | | | | | | | | |
| 18 | — | 127.6 | 120.2 | 118.2 | 39.2 | 35.9 | 42.0 | 11.4 |
| 19 | — | 59.4 | 187.0 | 200+ | 166.5 | 200+ | 55.0 | — |
| 20 | — | 85.9 | 200+ | 200+ | 191.1 | 200+ | 89.5 | — |
| 21 | — | 166.9 | — | 200+ | — | 181.5 | 126.5 | — |
| 22 | 200+ | 200+ | 200+ | 200+ | 175.8 | — | 200+ | 87.7 |
| 23 | — | 93.2 | 200+ | 200+ | — | 200+ | — | — |

Note:
200+ indicate that the peel strength is higher than the machine can measure.
– means that the laminate film is inseparable from the coating, laminate film itself broke before measurement, and coating came off with the laminate film.

What is claimed is:

1. An ink jet recording medium, comprising a paper or polymeric film substrate and two ink-receptive coating layers, wherein the first ink-receptive layer comprises about 10 to about 60 dry wt. % of alumina hydrate particulate and about 40 to about 90 dry wt. % of poly(2-ethyl-2-oxazoline), and the second ink-receptive layer comprises a blend of water-soluble polymers, wherein one of the water-soluble polymers is a quaternary amine-containing polymer, said second ink-receptive layer being coated on said first ink-receptive layer.

2. The ink jet recording medium of claim 1, wherein the substrate is a polymeric film selected from the group consisting of vinyl, polyethylene, polypropylene, polycarbonate, polyimide, polyester, and fluoroplastic films.

3. The ink jet recording medium of claim 1, wherein the substrate is an opaque polymeric film.

4. The ink jet recording medium of claim 1, wherein the substrate is a paper selected from the group consisting of plain paper, clay-coated paper, resin-coated, paper, latex-saturated paper, and polyethylene-coated paper.

5. The ink jet recording medium of claim 1, wherein the substrate is a polyethylene-coated paper.

6. The ink jet recording medium of claim 1, wherein the alumina hydrate particles in the first ink-receptive layer have a surface area of about 100 to about 200 m$^2$/g and an average dispersed particle size of about 40 to about 200 nm.

7. The ink jet recording medium of claim 1, wherein the first ink-receptive layer has a thickness of about 5 to about 50 $\mu$m.

8. The ink jet recording medium of claim 1, wherein the second ink-receptive layer further comprises a transitional metal salt selected from the group consisting of water-soluble copper (II) and cobalt (III) salts.

9. The ink jet recording medium of claim 8, wherein the transitional metal salt is copper (II) sulfate, copper (II) acetate, or cobalt (III) acetate.

10. The ink jet recording medium of claim 1, wherein the second ink-receptive layer has a thickness of about 0.1 about 10 $\mu$m.

11. An ink jet recording medium, comprising a paper or polymeric film substrate and two ink-receptive coating layers, wherein the first ink-receptive layer comprises a water-soluble polymer and alumina hydrate particulate, and the second ink-receptive layer comprises a quaternized vinyl pyrrolidone/dimethylaminoethylmethacrylate copolymer, said second ink-receptive layer being coated on said first ink-receptive layer.

12. An ink jet recording medium, comprising a paper or polymeric film substrate and two ink-receptive coating layers, wherein the first ink-receptive layer comprises poly (2-ethyl-2-oxazoline) and alumina hydrate particulate, and the second ink-receptive coating comprises a copolymer of vinyl pyrrolidone and quaternized dimethylaminoethylacrylate, stilbene-based optical brightener, and poly(methyl methacrylate) pigment, said second ink-receptive layer being coated on said first ink-receptive layer.

* * * * *